US009810399B2

(12) United States Patent
Kim et al.

(10) Patent No.: US 9,810,399 B2
(45) Date of Patent: Nov. 7, 2017

(54) LED LIGHTING APPARATUS

(71) Applicant: KMW Inc., Hwaseong, Gyeonggi-Do (KR)

(72) Inventors: Duk-Yong Kim, Gyeonggi-Do (KR); Youn-Chae Lim, Gyeonggi-Do (KR); Myoung-Seo Park, Gyeonggi-Do (KR)

(73) Assignee: KMW INC., Hwaseong, Gyeonggi-do (KR)

( * ) Notice: Subject to any disclaimer, the term of this patent is extended or adjusted under 35 U.S.C. 154(b) by 212 days.

(21) Appl. No.: 14/699,317

(22) Filed: Apr. 29, 2015

(65) Prior Publication Data

US 2015/0241023 A1 Aug. 27, 2015

Related U.S. Application Data

(63) Continuation of application No. PCT/KR2013/009629, filed on Oct. 28, 2013.

(30) Foreign Application Priority Data

Oct. 30, 2012 (KR) ..... 10-2012-0121277
Jun. 25, 2013 (KR) ..... 10-2013-0073097

(51) Int. Cl.
*F21V 7/04* (2006.01)
*F21S 8/02* (2006.01)
(Continued)

(52) U.S. Cl.
CPC ..... *F21V 7/04* (2013.01); *F21S 8/02* (2013.01); *F21S 8/03* (2013.01); *F21S 8/06* (2013.01);
(Continued)

(58) Field of Classification Search
CPC ..... F21S 8/03; F21S 8/036; F21S 8/04; F21V 21/02; F21V 21/03
See application file for complete search history.

(56) References Cited

U.S. PATENT DOCUMENTS 2,721,635 A * 10/1955 Fullerton ..... F21V 17/00 16/267
6,149,283 A 11/2000 Conway et al.
(Continued)

FOREIGN PATENT DOCUMENTS

EP 2278214 A1 1/2011
JP 06-131905 5/1994
(Continued)

OTHER PUBLICATIONS

EP Office Action dated in corresponding European Patent Application No. 13850576.3 dated May 6, 2016.

*Primary Examiner* — Andrew Coughlin
*Assistant Examiner* — Keith Delahoussaye
(74) *Attorney, Agent, or Firm* — Mintz Levin Cohn Ferris Glovsky and Popeo, P.C.; Kongsik Kim; Colleen H. Witherell

(57) ABSTRACT

An LED lighting apparatus is provided. The LED lighting apparatus includes a case part which covers a residual part, excluding a light-emitting surface, to provide a reflective space and has a predetermined depth and in which an upper edge of the inside thereof has a slope. Further, a receiving surface has a lateral surface portion of the case part that is bent toward the inside of the case. A substrate is fixed on the receiving surface and a plurality of LEDs are provided. A reflective part located in an upper center portion of the inside of the case part reflects the light of the LEDs and enables reflection and diffusion of light within the reflective space provided from the case part.

9 Claims, 12 Drawing Sheets

(51) Int. Cl.

| | |
|---|---|
| ***F21S 8/06*** | (2006.01) |
| ***F21V 7/00*** | (2006.01) |
| ***F21S 8/00*** | (2006.01) |
| ***F21V 21/30*** | (2006.01) |
| ***F21V 23/02*** | (2006.01) |
| *F21Y 103/10* | (2016.01) |
| *F21Y 115/10* | (2016.01) |

(52) U.S. Cl.

CPC ..... *F21V 7/005* (2013.01); *F21V 7/0008* (2013.01); *F21V 7/0041* (2013.01); *F21V 21/30* (2013.01); *F21V 23/023* (2013.01); *F21Y 2103/10* (2016.08); *F21Y 2115/10* (2016.08)

(56) References Cited

U.S. PATENT DOCUMENTS

| | | | | |
|---|---|---|---|---|
| 2007/0139922 | A1 | 6/2007 | Kuan et al. | |
| 2007/0211457 | A1* | 9/2007 | Mayfield | F21S 8/02 362/223 |
| 2007/0263379 | A1 | 11/2007 | Dowling | |
| 2008/0030982 | A1* | 2/2008 | Warton | F21S 8/06 362/219 |
| 2010/0172152 | A1* | 7/2010 | Boonekamp | F21V 7/0008 362/609 |
| 2011/0002682 | A1 | 1/2011 | Messina | |
| 2011/0164398 | A1* | 7/2011 | Holten | F21V 7/0008 362/84 |
| 2014/0133147 | A1 | 5/2014 | Jang | |

FOREIGN PATENT DOCUMENTS

| | | | |
|---|---|---|---|
| JP | 11-134913 | | 5/1999 |
| JP | 2001-243821 | A | 9/2001 |
| JP | 2003-36722 | | 2/2003 |
| JP | 2008-287994 | A | 11/2008 |
| JP | 2010-33893 | | 2/2010 |
| JP | 2011-29181 | | 2/2011 |
| JP | 2011-76863 | | 4/2011 |
| JP | 2012-204146 | A | 10/2012 |
| KR | 10-2010-0103327 | A | 9/2010 |
| KR | 10-0998980 | B1 | 12/2010 |
| KR | 10-2011-0009961 | A | 1/2011 |
| KR | 10-2011-0113699 | A | 10/2011 |
| WO | WO-00/34709 | A1 | 6/2000 |
| WO | WO-2008042324 | A2 | 4/2008 |
| WO | WO-2008146229 | A2 | 12/2008 |
| WO | WO-2009077979 | A1 | 6/2009 |
| WO | WO-2011002636 | A2 | 1/2011 |
| WO | WO-2011019753 | A1 | 2/2011 |

* cited by examiner

LED LIGHTING APPARATUS

CROSS REFERENCE TO RELATED APPLICATIONS

This application is a continuation of International Application No. PCT/KR2013/009629 filed on Oct. 28, 2013, which claims priority to Korean Applications No. 10-2012-0121277 filed on Oct. 30, 2012 and No. 10-2013-0073097 filed on Jun. 25, 2013, which applications are incorporated herein by reference.

TECHNICAL FIELD

The present invention relates to an LED lighting apparatus, and more particularly, to an LED lighting apparatus that can provide a variety of purposes and an extended installation function thereof.

BACKGROUND ART

In general, indoor lighting apparatuses using LEDs may be divided into apparatuses of a bulb type that replace typical bulbs, and surface-lighting apparatuses that replace fluorescent lamps.

Most of the surface-lighting apparatuses adopt a diffusion plate of a specific area as shown in Korea Patent No. 10-0998980 (registered on 1 Dec. 2010). The Patent discloses a configuration that includes a substrate having a plurality of LEDs for emitting light upwards mounted thereon, and at least one diffusion layer on the surface of the substrate, such that the light emitted from the plurality of LEDs is diffused to illuminate the entire surface of a specific area at a uniform intensity of illumination, as shown in the primary drawing, i.e., FIG. 4.

Such a configuration is usually adopted by the typical surface-lighting apparatuses, wherein the diffusion plate can prevent the light from emitting intensively from a specific portion to thereby eliminate the dazzle of a light, but the light-efficiency is lowered due to a significant light loss.

Accordingly, a multitude of LEDs, more than are needed, need to be used in order to provide a surface-lighting source that has a sufficient intensity of illumination. This may cause the strength of LED lights, i.e., low electric power consumption, to be useless. In addition, since it is not easy to deal with the heat emitted from the LEDs, the LED life-span may be shortened due to the heat.

Moreover, in the surface-lighting apparatus illustrated in FIG. 4 of the Patent above, if a typical lighting apparatus of 40 W is designed to be altered to a lighting apparatus of 20 W using LED chips of the same electric power, the design of a case should be changed.

In this case, the number of LEDs used in the lighting apparatus of 20 W is only half the number of LEDs used in the lighting apparatus of 40 W, so the gap between the LEDs become bigger due to the decrease in the number of LEDs. Accordingly, the diffusion plate just below the light-emitting surface of the LEDs shows bright portions and dark portions, which cause uneven illumination on the light-emitting surface.

In order to eliminate the unevenness of illumination, the distance between the LEDs and the diffusion plate should be adjusted to be longer through the change of the design. Alternatively, while the size of the light-emitting unit is to be reduced by half, another half of the light-emitting unit should be replaced with a reflection plate.

SUMMARY

In order to address the problem above, one aspect of the present invention provides an LED lighting apparatus that emits a uniform light with low electric power consumption without changing the size of the lighting fixture.

Furthermore, another aspect of the present invention provides an LED lighting apparatus in which the number of LEDs is reduced to thereby minimize the problem caused by the heat emitted from the LEDs.

In addition, still another aspect of the present invention provides an LED lighting apparatus that can prevent the dazzle of a light without using the diffusion plate.

In addition, still yet another aspect of the present invention provides an LED lighting apparatus an LED lighting apparatus that can provide a variety of purposes by easily replacing existing indoor fluorescent lighting fixtures, and can provide an extended installation function to satisfy the intensity of illumination required in the installed location thereof.

In accordance with a technical solution of the present invention, there is provided an LED lighting apparatus including: a case part which covers a residual part, excluding a light-emitting surface, to provide a reflective space and has a predetermined depth, in which an upper edge of the inside thereof has a slope; a receiving surface in which a lateral surface portion of the case part is bent toward the inside of the case; a substrate fixed on the receiving surface and in which a plurality of LEDs are provided; and a reflective part which is located in an upper center portion of the inside of the case part so as to reflect the light of the LEDs and enables reflection and diffusion of light within the reflective space provided from the case part.

DETAILED DESCRIPTION

Hereinafter, LED lighting apparatuses according to preferred embodiments of the present invention will be described with reference to the accompanying drawings.

Figure 1:
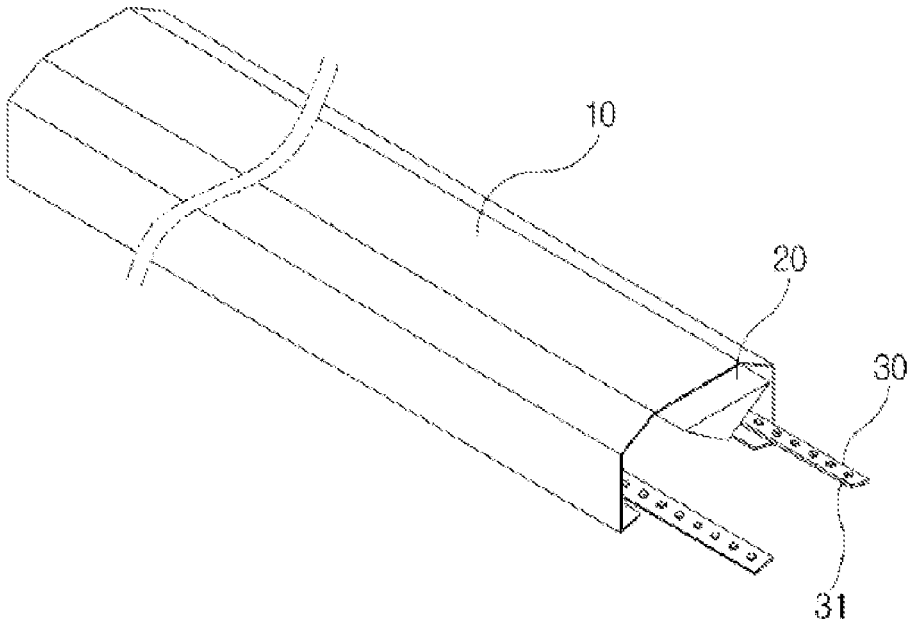
FIG. 1 is an exploded perspective view of an LED lighting apparatus according to a preferred embodiment of the present invention.
Figure 2:
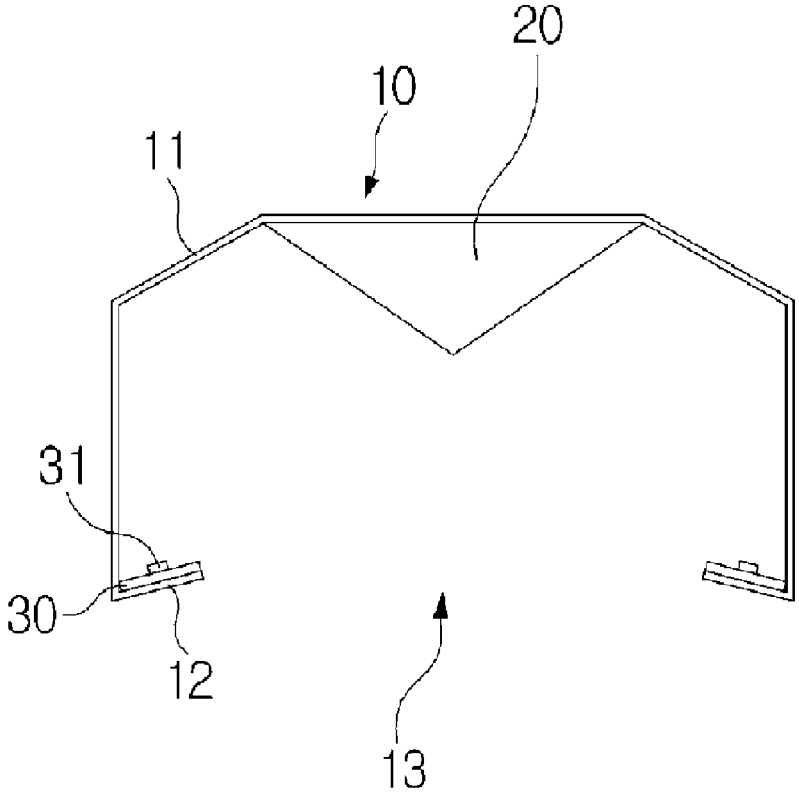
FIG. 2 is a sectional view of an LED lighting apparatus according to a preferred embodiment of the present invention.

FIG. 1 is an exploded perspective view of an LED lighting apparatus according to a preferred embodiment of the present invention, and FIG. 2 is a sectional view of an LED lighting apparatus according to a preferred embodiment of the present invention.

Referring to FIGS. 1 and 2, an LED lighting apparatus, according to a preferred embodiment of the present invention, includes: a case part 10 that has a shape of a box with a light-emitting surface 13 at the bottom thereof, a slope 11 formed to be slated on the upper portion inside the case part, and a receiving surface 12 formed to be slanted at the edges of both sides of the light-emitting surface 13; a reflective part 20 formed on the upper center portion inside the case part 10; and a substrate 30 that is installed on the receiving surface 12 and has a plurality of LEDs 31 mounted thereon.

Hereinafter, the operation and the effect of the LED lighting apparatus configured as set forth above, according to a preferred embodiment of the present invention, will be described in more detail.

First, the case part 10 is shaped into a box with an opening at the bottom thereof. That is, the case part 10 is formed of the light-emitting surface 13 at the bottom, and the remaining space except for the light-emitting surface 13 is enclosed to thereby provide a space in which the light of the LED 31 can be effectively reflected inside the case part 10.

The sides of the case part 10 are vertical with respect to the ground, and an end portion of the side is bent toward the inside of the case part 10 to thereby form the receiving surface 12. The receiving surface 12 is at an acute angle of less than 90° to the side of the case part 10.

The receiving surface 12 may be formed at both facing sides with respect to the light-emitting surface 13, and if necessary, it may be formed at one side or four sides.

The upper surface inside the case part 10 is flat on the center thereof, and the slope 11 is formed on the surface between the flat center portion and the sides of the case part. The slope 11 may be slanted more as it goes to the side of the case part 10.

The reflective part 20 is positioned on the flat center portion of the upper surface inside the case part 10. The reflective part 20 is shaped into an inverted triangle in its section, and it extends to the boundary of the slope 11 of the case part 10.

That is, the highest portion of the space between the case part 10 and the reflective part 20 to the ceiling is position on the boundary between the slope 11 of the case part 10 and the reflective part 20.

The substrate 30, on which a plurality of LEDs 31 is mounted, is fixed on the receiving surface 12. Accordingly, the light-emitting surface of the plurality of LEDs 31 is perpendicular to the receiving surface 12, and the light emitted from the LEDs 31 directly illuminates the inner surface of the side of the case part 10.

Figure 3:
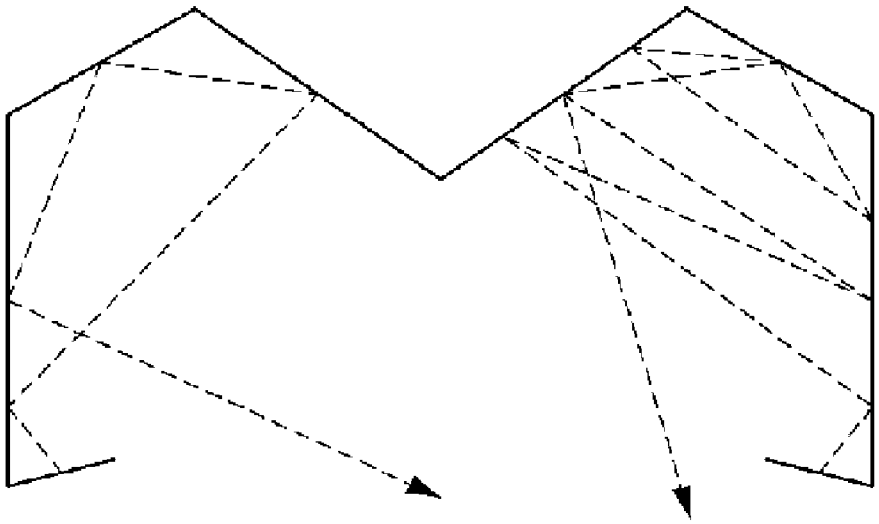
FIG. 3 is a conceptual diagram illustrating light-emitting of an LED lighting apparatus according to the present invention.

FIG. 3 is a conceptual diagram in which the light is reflected in the LED lighting apparatus according to the present invention.

Referring to FIG. 3, the light of the LED 31 is reflected by the side of the case part 10 to then continue to be reflected by the slope 11 of the case part 10 and the reflective part 20.

Therefore, it brings a phenomenon in which the light emitted from the LED 31 is reflected several times inside the case part 10 to be thereby captured inside the case part 10.

The light that has been captured emits downwards through the light-emitting surface 13 to illuminate.

As described above, the present invention provides the surface-lighting by the light that has been captured in the space of the case part 10 rather than direct illumination of the LED light, so the dazzle of a light can be attenuated without using lenses or diffusion plates.

As describe above, the present invention can improve the light-efficiency by eliminating the diffusion plate. Accordingly, the number of LEDs 31 can be reduced with respect to the same intensity of illumination, so a lighting apparatus of low electric power consumption can be provided.

In addition, with the reduction of the number of LEDs 31, the problem of the heat emitted from the LEDs 31 can be overcome. That is, the present invention can prevent the reduction of LED life-span due to the heat generation without adopting a separate heat-radiating structure.

One of the reasons why the present invention does not adopt the heat-radiating structure is as follows. Since the LEDs of typical LED lighting apparatuses are installed on the ceiling, the heat radiation by air convection is not easy. Therefore, the typical LED lighting apparatuses have been developed to adopt a separate heat-radiating structure. However, the present invention has a structure in which the LEDs 31 are installed to be spaced from the ceiling, which facilitates the heat radiation by air convection.

Figure 4:
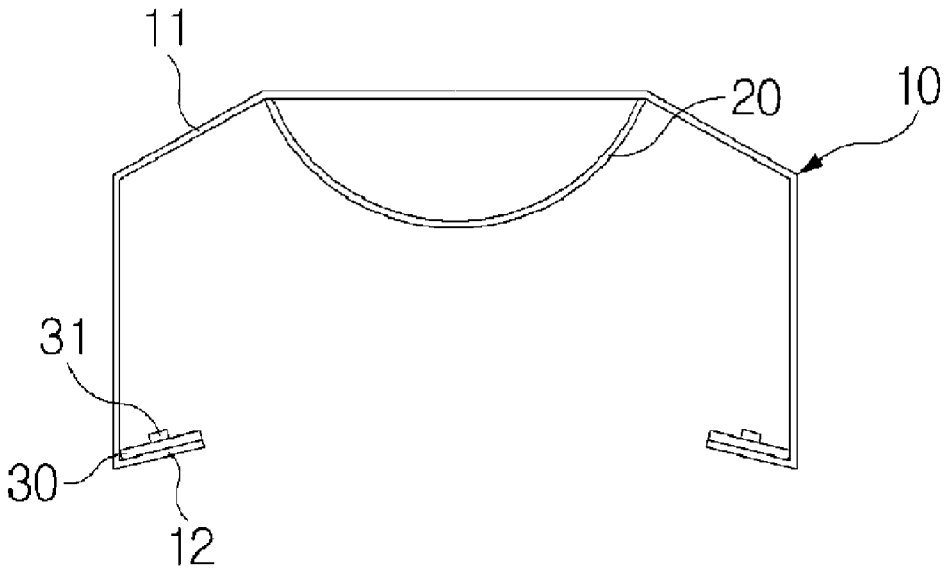
FIG. 4 is a sectional view of an LED lighting apparatus according to another embodiment of the present invention.
Figure 5:
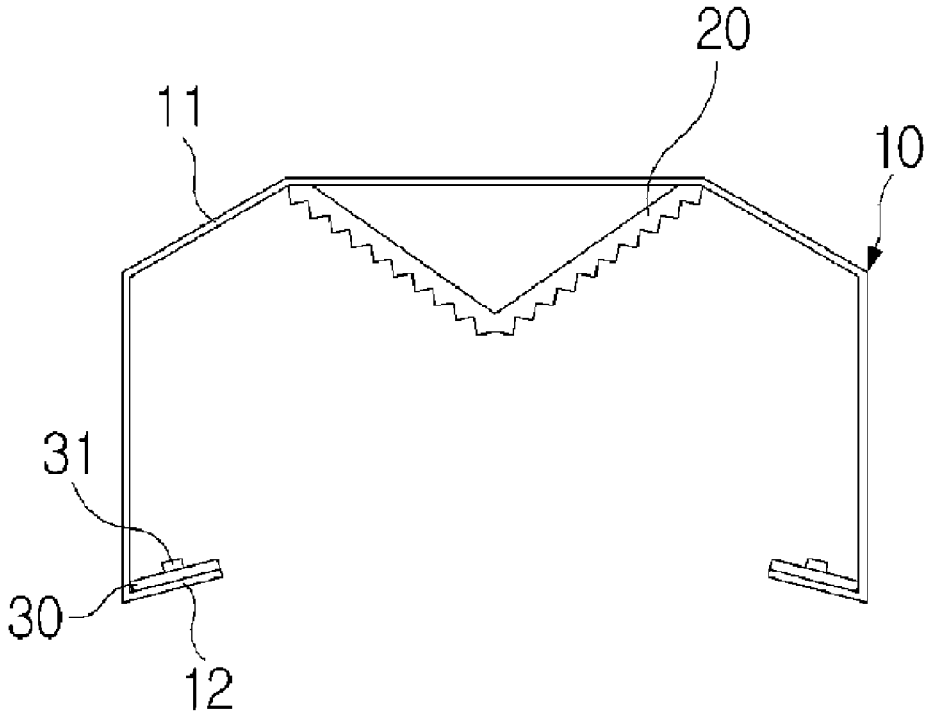
FIG. 5 is a sectional view of an LED lighting apparatus according to still another embodiment of the present invention.

FIGS. 4 and 5 are sectional views of an LED lighting apparatuses according to other embodiments of the present invention, respectively.

Referring to FIGS. 4 and 5, unlike the embodiment of FIG. 2, the reflective part 20 may be shaped into a semi-circle (FIG. 4), or may have a reflection surface of an inverted triangle, on which a plurality of stepped protrusions or embossments is formed, to have an uneven roughness.

The reflection surface having an uneven roughness in FIG. 5 may be applied to the reflective part 20 of FIG. 4.

The reflective part 20 in the shape of a semi-circle in its section in FIG. 4, and the inverted triangle structure having a plurality of stepped protrusions may diversify the reflection angle of light so that reflection and diffusion of light can be made diversely and irregularly within the space of the case part 10.

Such diverse and irregular reflection and diffusion of light may cause the diffusion of light to be more uniform, so the light emitted through the light-emitting surface 13 may be more similar to that of the surface-lighting source.

Although not all of the shapes of the reflective part 20 are illustrated and described in the present specification, any structure by which the light emitted from the LED 31 can be diffused in the space in the case part 10 may be applied to the present invention regardless of its detailed configuration.

Figure 6:
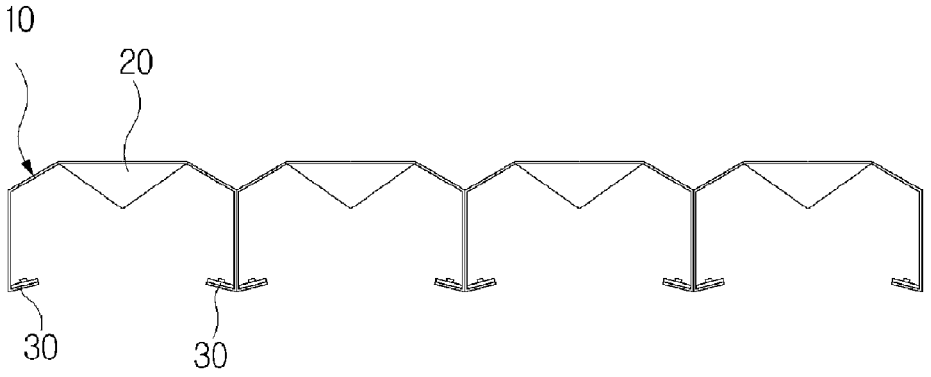
FIG. 6 is a sectional view of a lighting apparatus configured by connecting a plurality of LED lighting apparatuses of the present invention for a high intensity of illumination.

FIG. 6 is a sectional view of a configuration that can attain a high intensity of illumination using the present invention.

Referring to FIG. 6, the present invention may be applied to the places that require a relatively high intensity of illumination by combining a plurality of LED lighting apparatuses shown in FIG. 2.

The place that requires a relatively high intensity of illumination may be a place where the lighting apparatus is installed at a high position, such as spotlights at the factory, or streetlights.

FIG. 6 shows a configuration in which a plurality of LED lighting apparatuses are connected to satisfy a required intensity of illumination so that the outer surfaces of the sides of the case parts 10 contact with each other. This shows that the uniform design using a single LED lighting apparatus as a unit can be applied according to the required intensity of illumination without changing the design of the case part 10.

Figure 7:
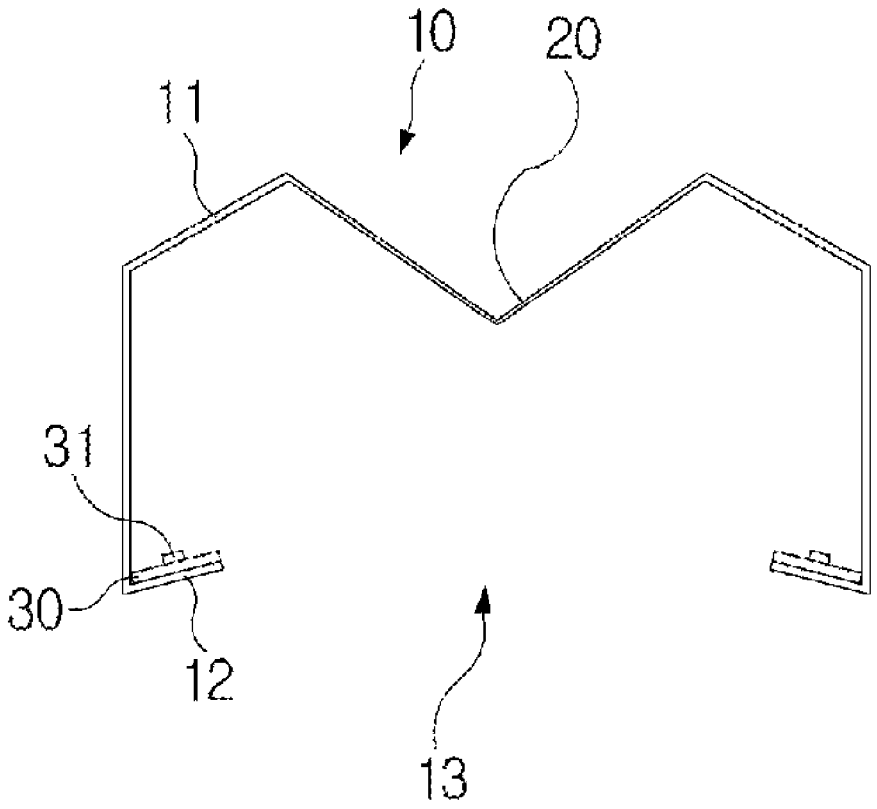
FIGS. 7 to 9 illustrate sectional views of an LED lighting apparatuses according to other embodiments of the present invention, respectively.

FIG. 7 illustrates a sectional view of an LED lighting apparatus according to another embodiment of the present invention.

Referring to FIG. 7, in the LED lighting apparatus according to another embodiment of the present invention, the upper and center portion of the case part 10 is bent into the shape of the reflective part 20 rather than adopting the reflective part 20 of the embodiments above. Thus, the light of the LED 31 can be reflected and diffused as enough of the reflective part 20 of the embodiments above in the case part 10.

This embodiment shows that the reflective part 20 may be a component separated from the case part 10, or the reflective part 20 may be integrally formed with the case part 10 as a single body by transforming the shape of the case part 10.

Figure 8:
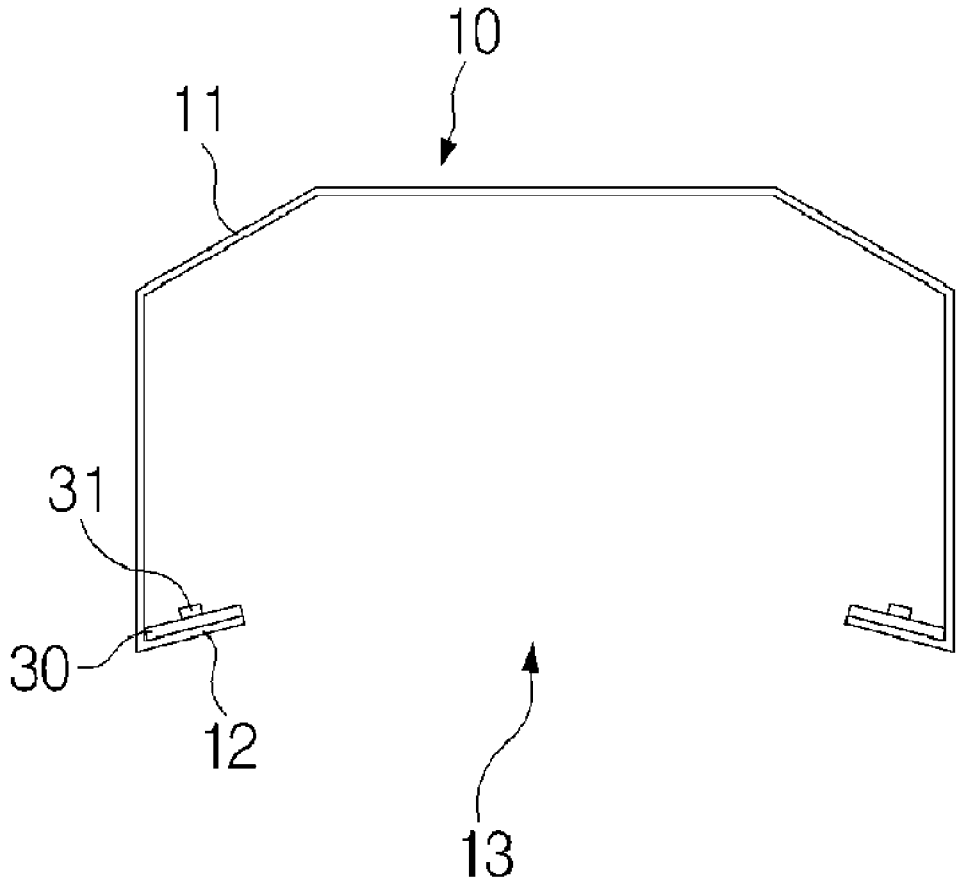

FIG. 8 illustrates a sectional view of an LED lighting apparatus according to still another embodiment of the present invention.

Referring to FIG. 8, in the LED lighting apparatus of the present embodiment, the upper and center portion inside the case part 10 is flat, different from the embodiment of FIG. 7.

In this configuration, the light of the LED 31 may be reflected and diffused in the case part 10, only depending on an angle between the receiving surface 12 and the inner surface of the side of the case part 10, and the degree of the slope 11 at the upper edge inside the case part 10 to thereby obtain the surface-light-emitting.

Figure 9:
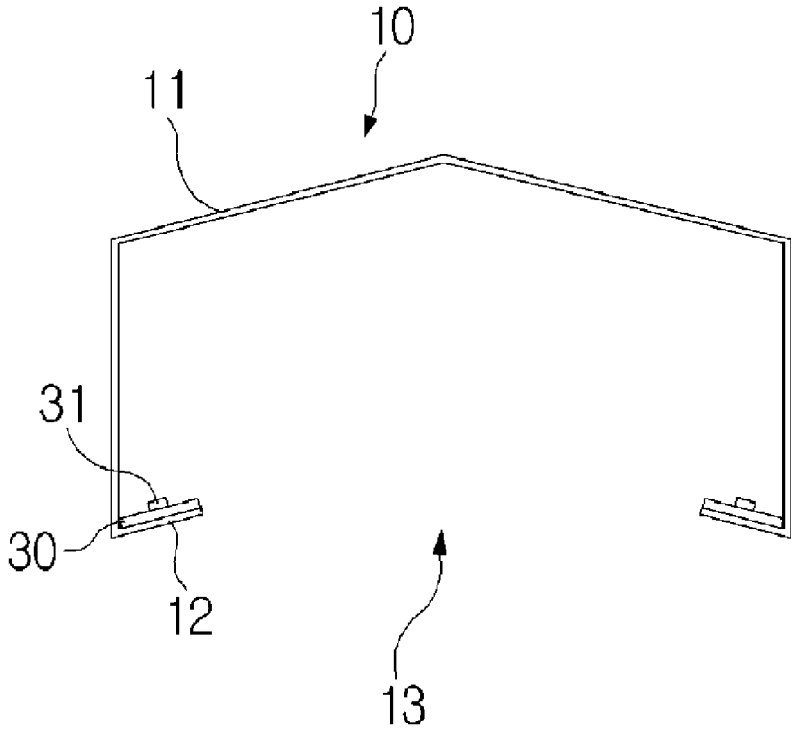

FIG. 9 illustrates a sectional view of an LED lighting apparatus according to still yet another embodiment of the present invention.

Referring to FIG. 9, in the LED lighting apparatus of the present embodiment, unlike the embodiment of FIG. 7, the slopes 11 meets each other at the upper and center portion of the case part 10 without adopting the reflective part 20 that is integrally formed with the case part 10.

Likewise, as stated in the embodiment of FIG. 8, in this configuration, the light of the LEDs 31 may be reflected and diffused in the case part 10, depending on an angle between the receiving surface 12 and the inner surface of the side of the case part 10, and the degree of the slope 11 to thereby attain the surface-light-emitting at the light-emitting surface 13.

Figure 10:
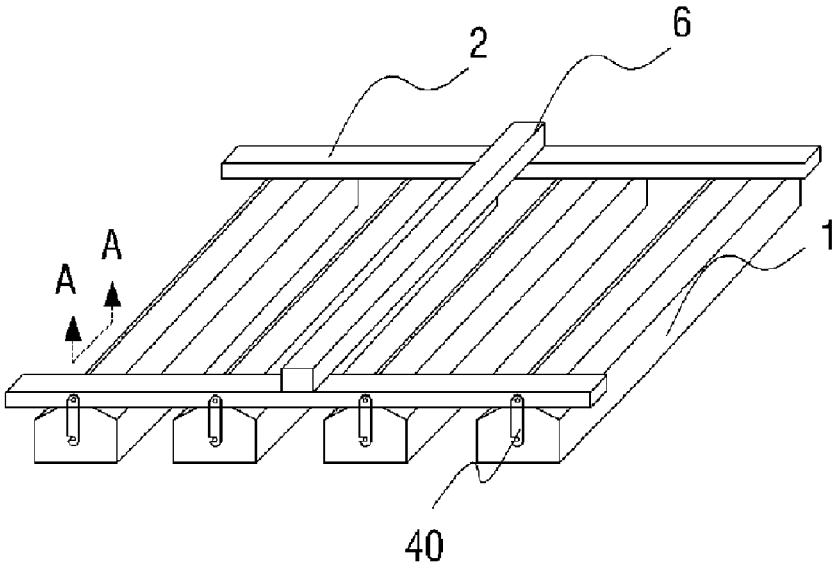
FIG. 10 is a view illustrating an example of installation of an LED lighting apparatus according to the present invention.
Figure 11:
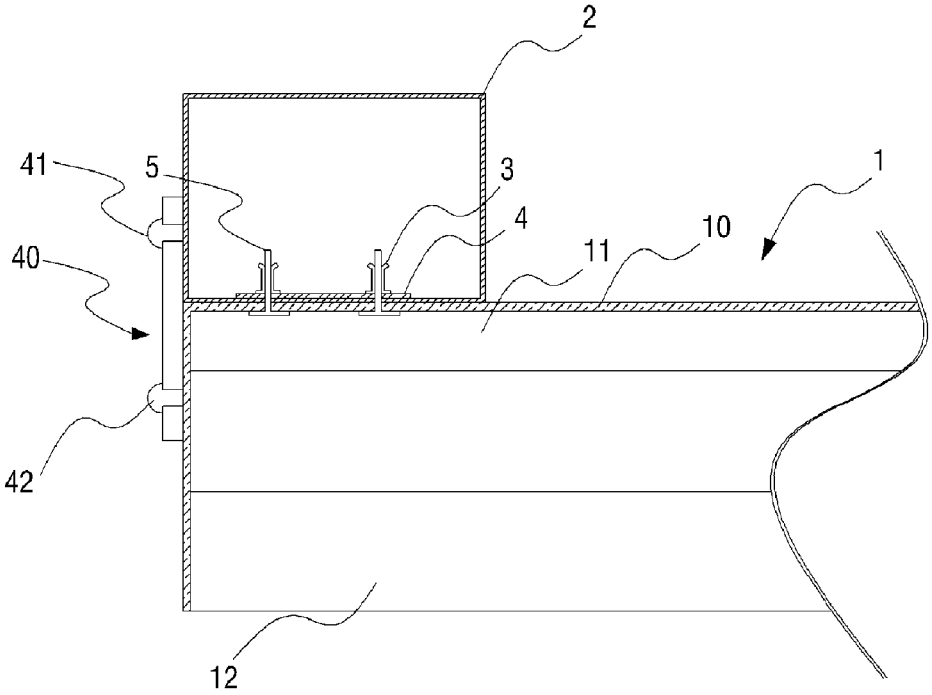
FIG. 11 is a sectional view taken along the line A-A of FIG. 10.

FIG. 10 is a view illustrating an example of installation of an LED lighting apparatus according to the present invention, and FIG. 11 is a sectional view taken along the line A-A of FIG. 10. In addition, FIG. 12 is a partial side view of FIG. 10 to describe the operation thereof.

Figure 12:
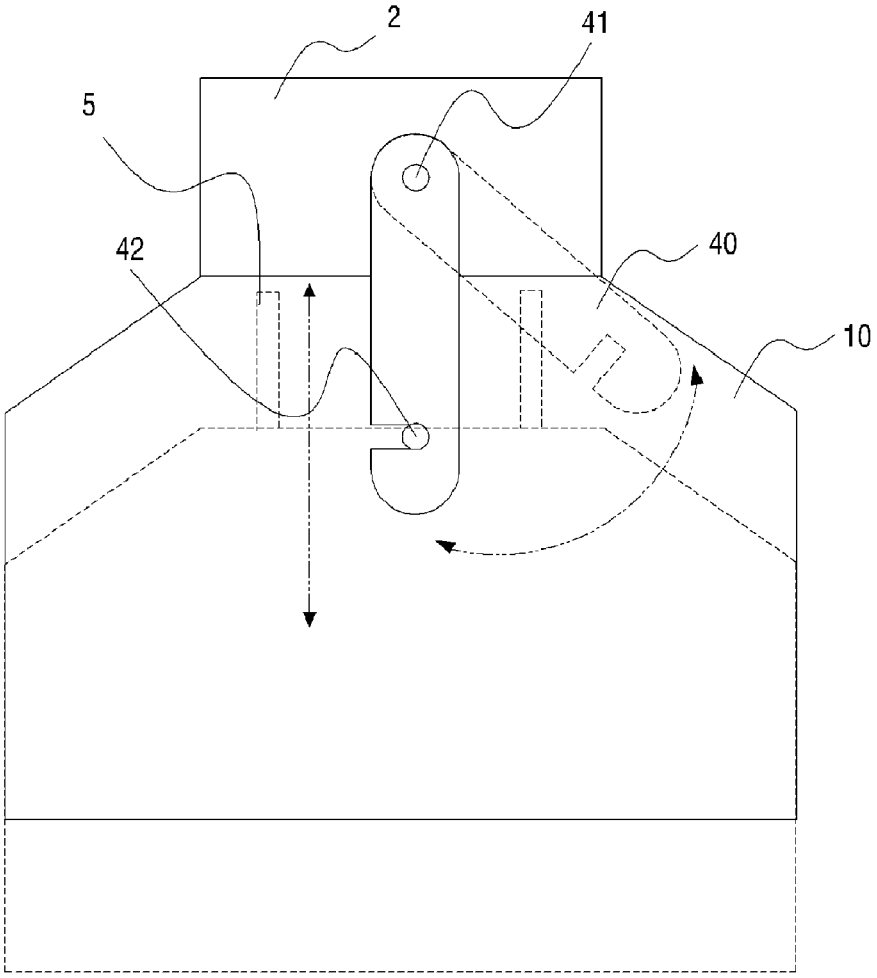
FIG. 12 is a partial side view of FIG. 10 to describe the operation thereof.

Referring to FIGS. 10 to 12, a plurality of LED lighting apparatuses, according to a preferred embodiment of the present invention, may be installed and fixed at both ends on the lower surfaces of a pair of support frames 2 that have socket 3 on the lower surface.

At this time, on the purpose of easy replacement of the LED lighting apparatus 1, the support frame 2 includes a rotating latch 40 on the side surface thereof, which rotates about a rotating axis 41 to connect with a fixing protrusion 42 formed on both sides of the LED lighting apparatus 1 so that the LED lighting apparatus 1 is detachably installed.

The rotating latch 40 has a planar shape, and may rotate with its position fixed by the rotating axis 41. The rotating latch 40 has a groove formed in the direction of rotation, and the fixing protrusion 42 fits into the groove to thereby fix the LED lighting apparatus 1 to the support frame 2.

The LED lighting apparatus 1 includes a plug 5 protruding from the portion that makes contact with the support frame 2. In addition, the plug 5 is inserted into the socket 3 provided in the support frame 2 to be supplied with the electric power, and the plug 5 is connected with a cable to supply the electric power to the substrate 30 on the receiving surface 12.

It is preferable that the socket 3 is configured to have an elastic force acting on the side surface of the plug 5 so that the plug 5 is prevented from easily popping out to be thereby in the stable supply of the electric power.

In addition, the LED lighting apparatus 1 according to the present invention can be easily attached and detached by the rotating latch 40 as shown in FIG. 12. A plurality of LED lighting apparatuses may be installed on the support frame 2 by the rotating latch 40 as needed to provide a lighting apparatus of the intensity of illumination that satisfies the purpose of use, and a spoiled LED lighting apparatus 1 can be easily replaced with a new one.

Undescribed reference numeral 6 denotes a fixing frame that connects the pair of support frames 2 to fix the same. The fixing frame 6 is further provided with a wire for installing the same on the ceiling or other places. In addition, although it is not shown in the drawing, the fixing frame 2 may further include a power supply unit that converts an alternating current supplied from the outside into a direct current to be thereby supplied to the socket 3 through a substrate 4 provided on at least one of the pair of support frames 2.

The present invention according to the configuration as described above can be easily attached and detached, and each of the LED lighting apparatus can be separately replaced as needed so that the cost of repair and maintenance can be reduced.

The present invention is not limited to the embodiments above, and it is obvious for those skilled in the art that the present invention may be modified and transformed for implementation in various ways.

For example, the entire area of the inner surface of the case part 10 may be coated with a reflection surface, or a reflection sheet may be attached thereon.

The present invention can provide a uniform intensity of illumination at low power consumption, and can considerably reduce the dazzle of a light compared to other LED lighting apparatuses. In addition, the present invention can easily replace typical fluorescent lighting fixtures, so it has industrial usability.

The LED lighting apparatus of the present invention includes a case that provides a reflective space to enable the surface-lighting by reflection, and LEDs that are positioned to be slanted at the side of a light-emitting surface of the case and of which a light-emitting surface faces the reflective space so that the light emitted from the LED is reflected by the case to thereby attain the surface-lighting. Therefore, the present invention can provide an LED lighting apparatus that emits a uniform light with low electric power consumption without changing the size of a lighting fixture.

In addition, the lighting apparatus of volume-light-emitting, according to the present invention, can prevent the dazzle of a light without the diffusion plate by making the surface-lighting through the first reflection and the diffusion of a light of the LED by a reflection surface. In addition, the lighting apparatus of the present invention can improve the light-efficiency by removing the diffusion plate to thereby reduce the number of LEDs.

In addition to the reduction of the LEDs, the electric power consumption and the manufacturing cost can be reduced as well. Moreover, since a separate structure for heat-radiation is not required, as a result of the minimization of heat-generation, the weight of the lighting apparatus can be reduced, and the structure thereof can be simplified.

Furthermore, the present invention can provide a variety of purposes by easily replacing existing recessed fluorescent lighting fixtures, and can provide a lighting apparatus that satisfies an intensity of illumination required in the installed location thereof through the extension of the number of LEDs installed as needed.

What is claimed is:

1. An LED lighting apparatus comprising:

a case part having a reflective space having a predetermined depth, and that has a slope formed on the upper portion inside the case part;

a substrate that is fixed on a receiving surface, and has a plurality of LEDs mounted thereon; and a pair of support frames on which a plurality of case parts is installed at two opposing ends, and the pair of support frames includes a rotating latch provided on a side surface thereof to facilitate attachment and detachment of the case part, wherein the support frame includes a socket for supplying electric power, and a plug connected with the substrate protrudes from an upper portion of the support frame so that the support frame and the case part are connected with each other to supply electric power to the substrate.

2. The LED lighting apparatus as claimed in claim 1, wherein the receiving surface is at an acute angle to the inner surface of the side of the case part.

3. The LED lighting apparatus as claimed in claim 1, further comprising a reflective part that is positioned on the upper and center portion inside the case part to reflect light so that the light is reflected and diffused in the reflective space provided by the case part.

4. The LED lighting apparatus as claimed in claim 3, wherein the reflective part is formed of the upper and center portion of the case part, which is bent downwards.

5. The LED lighting apparatus as claimed in claim 3, wherein the slope of the upper portion inside the case part extends from the reflective part to the side of the case part, and the slope is more slanted downwards as it goes to the side of the case part.

6. The LED lighting apparatus as claimed in claim 1, wherein the slopes of the upper portion inside the case part meet each other at the upper and center portion inside the case part, and extend to the sides of the case part, and the slopes are more slanted downwards as they go to the sides of the case part.

7. The LED lighting apparatus as claimed in claim 3, wherein the reflective part is shaped into an inverted triangle or a semi-circle in section.

8. The LED lighting apparatus as claimed in claim 7, wherein the reflective part provides a reflection surface having stepped protrusions or embossments.

9. The LED lighting apparatus as claimed in claim 1, wherein the rotating latch rotates with its position fixed by a rotating axis provided on the side of the support frame, and the rotating latch has a groove into which a fixing protrusion formed on both sides of the case part fits.

* * * * *